US005279514A

United States Patent [19]

Lacombe et al.

[11] Patent Number: 5,279,514

[45] Date of Patent: Jan. 18, 1994

[54] GIFT WITH PERSONALIZED AUDIO MESSAGE

[76] Inventors: David Lacombe, 7817 Lyndora St., Downey, Calif. 90242; Sherry Yu-Kim, 14468 Benefit St., #4, Sherman Oaks, Calif. 91423; George Seelman, 362 Forest Pl., Vista, Calif. 92083

[21] Appl. No.: 977,046

[22] Filed: Nov. 16, 1992

[51] Int. Cl.[5] ..... A63H 3/28

[52] U.S. Cl. ..... 446/297; 446/175

[58] Field of Search ..... 369/31, 67, 68, 69, 369/70, 65, 66, 63, 64; 446/297, 298, 299, 300, 302, 303, 397, 404, 270, 484, 175; 434/335, 320; 365/45, 189.01, 222

[56] References Cited

U.S. PATENT DOCUMENTS 4,627,027 12/1986 Rai et al. ..... 365/45
4,696,653 9/1987 McKeefery ..... 446/303 X
5,059,149 10/1991 Stone ..... 446/302 X

*Primary Examiner*—Robert J. Pascal
*Assistant Examiner*—Ali Neyzari
*Attorney, Agent, or Firm*—Ralph S. Branscomb

[57] ABSTRACT

A gift item which is illustrated in the form of a stuffed teddy bear houses a control system which incorporates a re-programmable solid state analog memory device which is used to record a message. In the illustrated embodiment, a write switch is housed in the teddy bear's ear, and while it is being squeezed, a microphone in the main control system will record a spoken message into the non-volatile analog memory. The recording will take place as long as the two-contact switch is squeezed, and will stop upon release of the switch or expiration of the memory capacity of the memory device, which is about 20 seconds. The message is played back by momentary compression of another two-contact switch placed in the bear's paw, which would typically be done by a child. Replacement of a prior message with a subsequent one can be done at will by closing the write switch again as was done initially.

11 Claims, 2 Drawing Sheets

GIFT WITH PERSONALIZED AUDIO MESSAGE

BACKGROUND OF THE INVENTION

Recording and played-back devices utilized in toys, books and other educational items have become increasingly popular in the last decade and are now a dominant feature of the Christmas season. Items of this nature include books, animals and displays that play back messages, music, or animal sounds, etc. which have been prerecorded in read-only memory chips (ROM). This type of device of course cannot be re-programmed, and although it may have several alternative messages, they cannot be overwritten or changed.

There are older toys and the like which enable the owner to record messages, for example on a tape cassette in a tape player housed within the toy, to be played back later by a child. Though this non-volatile memory is effective in recording and subsequently playing back a message, it is of course rather cumbersome for the purpose, being mechanical and unnecessarily having a number of moving parts.

Yet another gift item or novelty is one which can repeat back something spoken to it or another noise delivered to it immediately after the audio input. These devices, such as parrots which will repeat the child's words after the child says them, utilize digital RAM chips, which are of course volatile memory devices and cannot retain the message when powered down, which is why they will only repeat the message immediately after it is input into the device. However, this system does have the advantage of being overwritable innumerable times.

The final development of such a trend would be a gift item such as a stuffed animal which has all of the advantages of the above-stated devices incorporated into a single unit.

SUMMARY OF THE INVENTION

The instant invention provides all of the advantages of the above-stated unit, including a solid state, re-programmable nonvolatile memory which needs virtually no power to store an audio message. The entire system, when not in active use, requires a very minute trickle current to enable it to maintain in a ready state, with standard digital equipment power requirements being effective during the short periods of time when the unit is either recording or playing back a message.

Although the embodiments of the invention are actually endless, the illustrated embodiment is a teddy bear having a write switch in its ear and a read switch in its paw.

DETAILED DESCRIPTION OF THE PREFERRED EMBODIMENT

Figure 1:
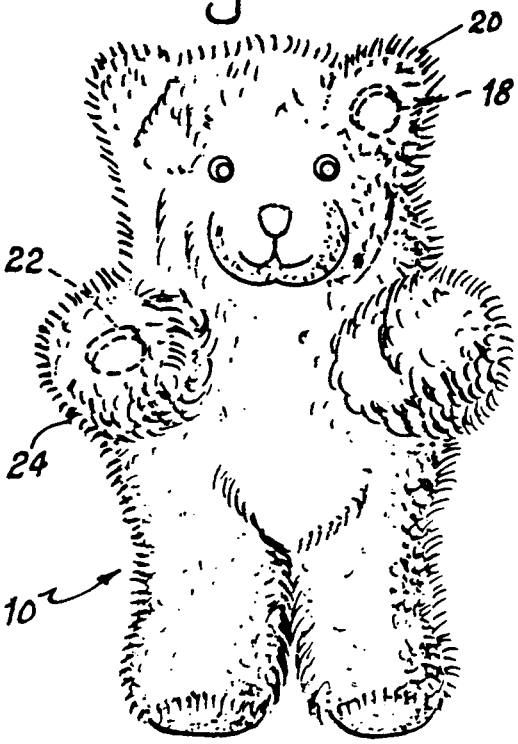
FIG. 1 is a front elevation view of a teddy bear illustrating the switches in phantom.
Figure 2:
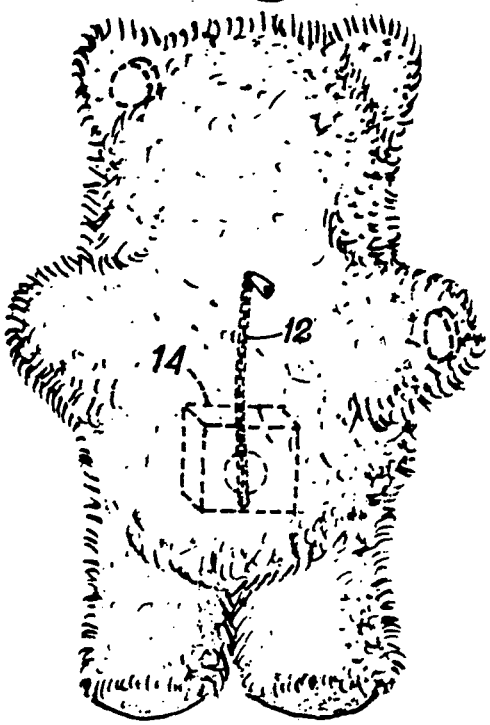
FIG. 2 is a rear elevation view of the teddy bear illustrating the zipper which opens the cavity housing the control system of the unit.
Figure 3:
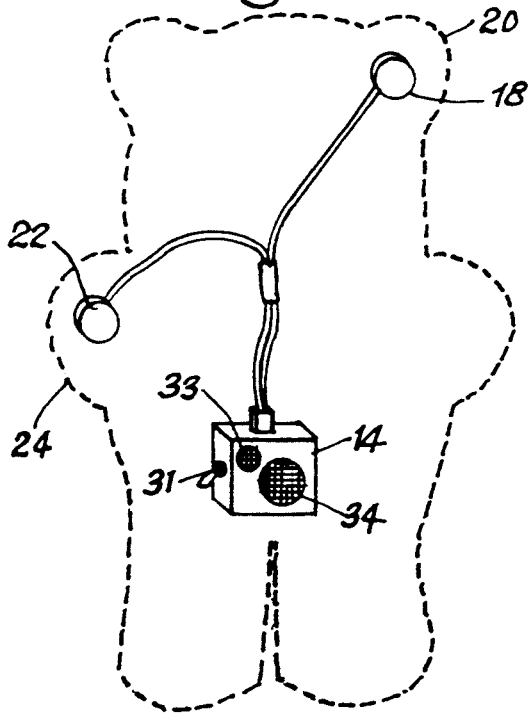
FIG. 3 illustrates the control system and its switches approximately as they are positioned in the teddy bear.

The teddy bear shown in FIG. 1 at 10 is on the one hand an example of any stuffed animal or other toy in which the invention could be incorporated, and on the other hand is the invention itself, inasmuch as the unit could be considered a talking teddy bear invention. The teddy bear is stuffed and covered as are most teddy bears, but defines an internal cavity which is characteristic of talking animals of this type, with the cavity being enclosed with the zipper 12. Access is needed for the box 14 of the control system 16 to replace the batteries.

The internal cavity system of the bear includes passageways which permit wires to extend up to a write switch 18 in the ear 20 of the bear, and to a read switch 22 housed in the bear's paw 24.

Figure 4:
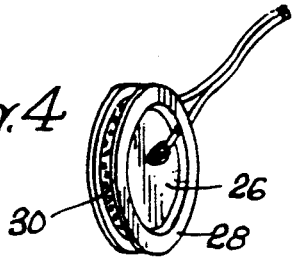
FIG. 4 illustrates a typical type of switch that would be used and is used in the illustrated embodiment both for the read switch and the write switch.

Both switches are of the type illustrated in FIG. 4. This is a very simple switch with two broad contacts 26 having annular rims 28 which are spaced apart by an annular foam ring 30 such that when the contact plates are compressed, they make contact in the broad central region to close the switch.

The write switch 18 actuates a microphone 33 which is the input transducer to the input audio circuit 19 of the control system, which, when actuated causes the audio input signal, or verbal message, to be encoded in the analog storage device 32. As long as the contacts of the write switch 18 are closed, the message will be continuously written into the solid state memory 32 of the control system. When the write switch is released, the recording terminates. The memory will only hold an encoded audio signal that is 17 to 20 seconds long, and if the write switch is closed for a period longer than that, the system is automatically put into its power-down mode.

When the write switch is closed again, the message previously written into the memory is overwritten by the new message. In some situations however, it is not desireable that the existing message be overwritten by pressing the write switch. For example, the sender might want a permanent message recorded, or fear that the message would be accidentally erased. To address this situation, an overwrite disable toggle switch 31 is included in the control system.

The read switch 22 actuates the output audio circuit 35 and the speaker transducer 34. Once the read switch is closed, the message will play through to the end. The read switch does not have to be maintained closed for the message to complete.

Figure 5:
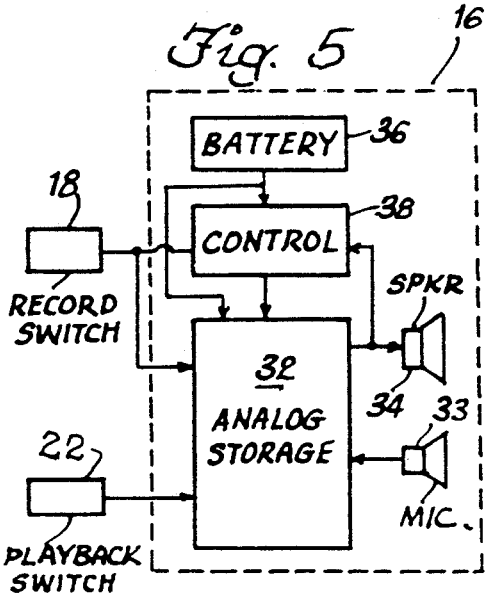
FIG. 5 is a block diagram illustrating the flow of the system.
Figure 6:
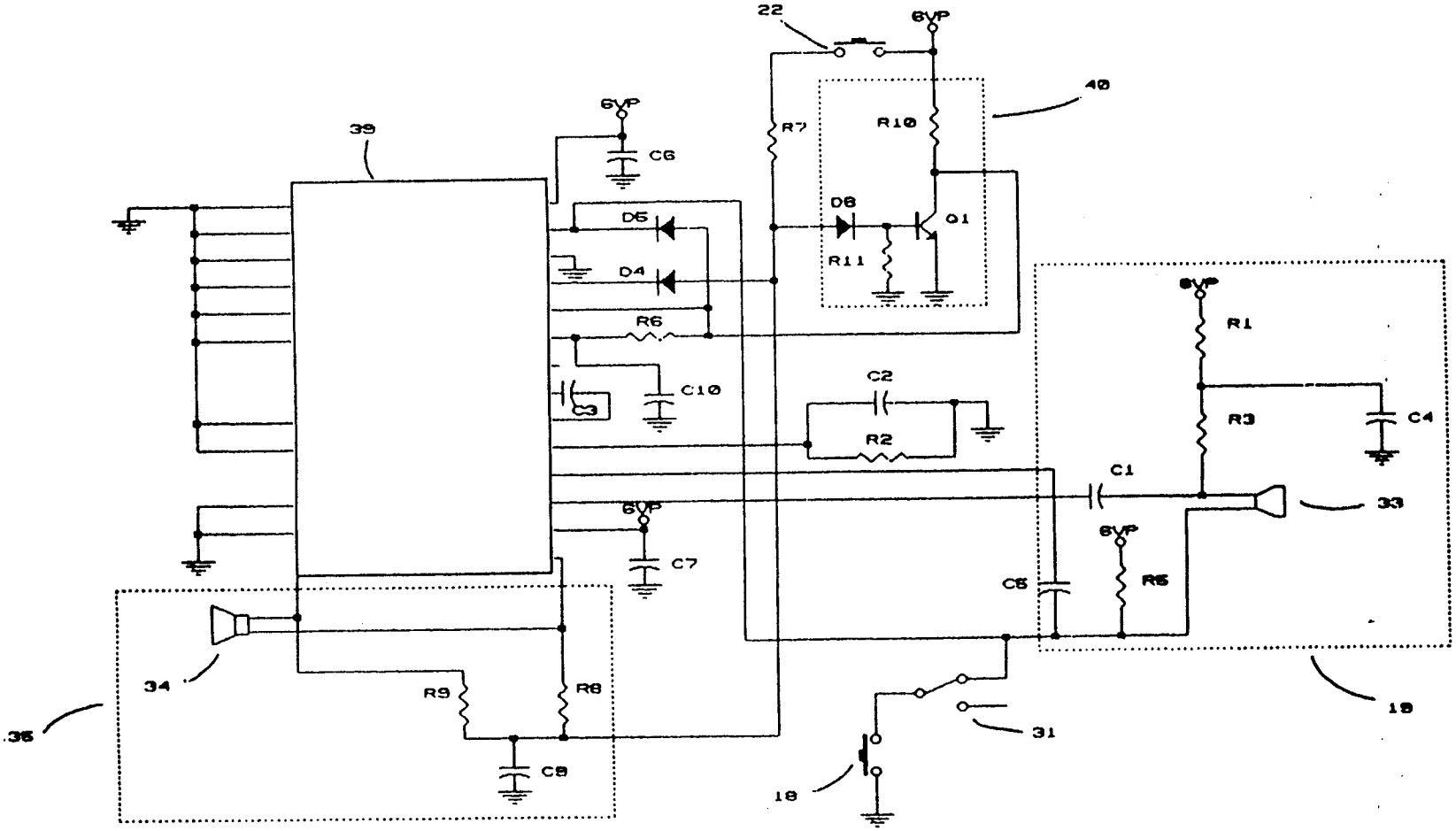
FIG. 6 is a schematic of the control system including the IC containing the analogue memory, with the numerical readout alongside the IC representing IC pin numbers rather than reference numbers.

As illustrated in FIG. 5, the control system 16 includes a battery 36, a control unit 38, and the memory unit itself 32. The memory and most of the control circuitry are incorporated in a single chip 39 shown in the schematic of FIG. 6. What circuitry is not inside the integrated circuit of the control system, necessary to interface with the outside world, inludes the input circuit 19, the output circuit 35, and the power shut-down circuit 40.

A teddy bear such as this has innumerable uses. A mother can program a brief instruction to her child so that the child can play it back if the child comes home before the mother gets off work, for example. A message can be delivered from a friend or loved one, and then another message returned to the sender, and so forth. Due to the solid state non-volatile analog memory innovation, re-programmability and minimal power usage make the invention feasible. Not only is the message overwritable by the speaker, which would often be a parent, but it would be played back in a voice that is remarkably similar to the voice of the speaker who programmed the message. Therefore, for a child, not only does it deliver the contents of the message, but also in the voice that is comforting and soothing to the child.

It is hereby claimed:

1. A gift item with means to program an audio signal into a solid state non-volatile memory for indefinite low-power storage and causing that signal to be vocalized on demand, with the memory being repeatedly re-programmable independently of external support equipment or moving memory apparatus, said gift item comprising:

(a) a body;

(b) a control system housed inside said body and including an input audio transducer and circuit, a non-volatile re-programmable solid state memory capable of storing an encoded audio signal from said input audio circuit of at least several seconds in length, and an output audio circuit and transducer for decoding and playing back a signal stored in said memory;

(c) a write switch for actuating said input audio transducer and circuit to encode said audio signal into said memory for storage;

(d) a read switch for actuating said output audio circuit and transducer for decoding the audio signal from said memory and vocalizing same; and, (e) said control system including a power-down circuit for limiting power consumption by said system upon termination of either an audio input signal or a vocalized output signal.

2. A gift item according to claim 1 wherein said memory comprises an integrated circuit.

3. Structure according to claim 2 wherein said memory is a solid state analog storage integrated circuit.

4. Structure according to claim 1 wherein said gift item comprises a stuffed toy and said switches are confined within said toy and operable from externally of said body by application of tactile pressure.

5. Structure according to claim 1 wherein said switches comprise normally-open spaced-apart plate contacts operative when compressed together to close the respective circuit through the contacts.

6. Structure according to claim 5 wherein said audio input transducer and circuit are active to overwrite a signal previously stored in said memory when said write switch is closed.

7. Structure according to claim 6 and including an overwrite disable switch in said input audio circuit allowing the overwrite function to be optionally disabled.

8. Structure according to claim 5 wherein said read switch is configured with said audio output circuit as a momentary switch such that a single momentary closing of said switch actuates said output circuit to transduce the signal stored in said memory in its entirety.

9. Structure according to claim 4 wherein said body defines a cavity housing said control system and said stuffed toy has extremities housing said switches.

10. Structure according to claim 9 wherein said stuffed toy is a teddy bear.

11. Structure according to claim 10 wherein said write switch is housed in an ear of said teddy bear and said read switch is housed in one of the limbs of said teddy bear.

* * * * *